US012446703B2

(12) United States Patent
Shih et al.

(10) Patent No.: US 12,446,703 B2
(45) Date of Patent: Oct. 21, 2025

(54) FOLDABLE ELECTRIC BED

(71) Applicant: Chuan-Hang Shih, Lukang Township, Changhua County (TW)

(72) Inventors: Chuan-Hang Shih, Lukan Township (TW); Yu-Chi Yang, Lukang Township (TW)

(73) Assignee: STAR SEEDS CO., LTD., Taichung (TW)

( * ) Notice: Subject to any disclaimer, the term of this patent is extended or adjusted under 35 U.S.C. 154(b) by 288 days.

(21) Appl. No.: 18/130,175

(22) Filed: Apr. 3, 2023

(65) Prior Publication Data

US 2024/0206633 A1 Jun. 27, 2024

(30) Foreign Application Priority Data

Dec. 22, 2022 (TW) ..... 111149356

(51) Int. Cl.
*A47C 20/04* (2006.01)

(52) U.S. Cl.
CPC ..... *A47C 20/041* (2013.01)

(58) Field of Classification Search
CPC ..... A47C 20/041
USPC ..... 5/616
See application file for complete search history.

(56) References Cited

U.S. PATENT DOCUMENTS 2,869,614 A * 1/1959 Wamsley ..... A61G 5/006 280/211
3,012,253 A * 12/1961 Reichert ..... A61G 7/002 5/616
3,089,150 A * 5/1963 Briggs ..... A47C 20/08 5/616
3,174,161 A * 3/1965 Black ..... A61G 7/002 5/616
3,414,913 A * 12/1968 Stanley ..... A61G 7/002 5/616
3,644,946 A * 2/1972 Swatt ..... A61G 7/015 5/616
3,821,821 A * 7/1974 Burst ..... A61G 7/002 5/616
3,839,753 A * 10/1974 Benoit ..... A61G 7/002 5/616
3,932,903 A * 1/1976 Adams ..... A61G 7/015 5/100
3,958,283 A * 5/1976 Adams ..... A61G 7/002 5/616

(Continued)

*Primary Examiner* — Amber R Anderson
*Assistant Examiner* — Luke Hall
(74) *Attorney, Agent, or Firm* — Birch, Stewart, Kolasch & Birch, LLP

(57) ABSTRACT

A foldable electric bed includes pivotally connected front and rear frames, first buttock and back supporting units linked together and slide on the front frame, a first actuator disposed with the first buttock and back supporting units, a bottom frame slidably disposed with the rear frame, second buttock, thigh and lower leg supporting units linked together and disposed with the bottom frame, a quick release connected with the first and second buttock supporting units, and a second actuator disposed with the thigh supporting unit and the bottom frame. When the back supporting unit is driven by the first actuator to swing upwardly, the first and second buttock supporting units, the bottom frame, and the thigh and lower leg supporting units are driven to slide forwards.

16 Claims, 10 Drawing Sheets

(56) References Cited

U.S. PATENT DOCUMENTS 4,025,972 A * 5/1977 Adams ..... A61G 7/0509 5/616
4,095,296 A * 6/1978 Ferro ..... A61G 7/015 5/616
4,376,316 A * 3/1983 Mercier ..... A47C 20/041 5/616
4,381,571 A * 5/1983 Elliott ..... A61G 7/015 5/616
4,463,463 A * 8/1984 Kaneko ..... A61G 7/015 5/616
4,675,926 A * 6/1987 Lindblom ..... A61G 7/002 74/606 R
4,712,441 A * 12/1987 Abraham ..... F16H 25/2015 74/412 TA
5,165,129 A * 11/1992 Rohm ..... A61G 7/015 5/616
5,542,744 A * 8/1996 Bathrick ..... A47C 20/041 74/89.41
5,579,550 A * 12/1996 Bathrick ..... A47C 19/005 5/618
5,584,082 A * 12/1996 Crawford ..... A61G 5/006 5/616
5,937,459 A * 8/1999 Binaghi ..... A47C 20/041 254/102
6,088,853 A * 7/2000 Jansen ..... A61G 7/015 5/616
6,276,011 B1 * 8/2001 Antinori ..... A47C 20/041 5/613
6,293,723 B1 * 9/2001 Kiefer ..... B60N 2/929 403/21
6,393,641 B1 * 5/2002 Hensley ..... A47C 20/08 5/616
6,499,162 B1 * 12/2002 Lu ..... A47C 20/08 5/616
6,691,346 B2 * 2/2004 Osborne ..... A61G 7/052 5/616
6,739,004 B1 * 5/2004 Abrahamsen ..... A47C 20/041 74/425
7,025,421 B1 * 4/2006 Fowler ..... A47C 3/36 297/325
7,036,165 B2 * 5/2006 Weinman ..... A61G 7/015 5/617
7,448,100 B1 * 11/2008 Shih ..... A61G 7/015 5/619
7,810,189 B2 * 10/2010 Boudreau ..... A47C 19/22 5/613
7,992,240 B2 * 8/2011 Gladney ..... A47C 21/026 5/617
7,996,939 B2 * 8/2011 Benedict ..... A61G 1/0212 5/614
8,069,512 B2 * 12/2011 Rawls-Meehan ..... A61G 7/015 5/617
8,312,579 B2 * 11/2012 Bock ..... A61G 7/015 5/616
8,615,828 B2 * 12/2013 Schermel ..... A47C 20/04 297/411.31
8,806,682 B2 * 8/2014 Hornbach ..... A61G 7/018 5/619
8,910,328 B2 * 12/2014 Clenet ..... A61G 7/002 5/616
9,009,896 B2 * 4/2015 Suh ..... A47C 19/122 5/618
9,044,366 B2 * 6/2015 Rawls-Meehan ..... A61G 7/018
9,125,776 B1 * 9/2015 Shih ..... A61G 7/018
9,173,793 B2 * 11/2015 Rawls-Meehan ..... A47C 20/08
9,642,760 B2 * 5/2017 Jackson ..... A61G 13/0036
9,763,840 B2 * 9/2017 Rigsby ..... A61G 7/0513
10,143,312 B2 * 12/2018 Brosnan ..... A47C 20/041
10,299,976 B2 * 5/2019 Lo ..... A61G 7/015
10,306,994 B2 * 6/2019 Barr ..... A47C 19/025
10,406,050 B2 * 9/2019 Reinke ..... A61G 7/015
10,463,164 B2 * 11/2019 Kramer ..... A47C 20/08
10,568,434 B2 * 2/2020 Kramer ..... A47C 20/041
10,646,390 B2 * 5/2020 Clenet ..... A47C 20/04
11,304,864 B2 * 4/2022 Sweeney ..... A61G 5/14
2002/0178502 A1 * 12/2002 Beasley ..... A61G 7/015 5/618
2003/0052238 A1 * 3/2003 Schneider ..... A47C 20/08 248/421
2004/0020316 A1 * 2/2004 Dewert ..... A47C 20/041 74/89.23
2004/0148704 A1 * 8/2004 Tekulve ..... A61G 7/015 5/618
2005/0210588 A1 * 9/2005 Loewenthal ..... A47C 20/041 5/618
2006/0022500 A1 * 2/2006 Roither ..... A47C 20/041 297/362
2007/0163046 A1 * 7/2007 Eriksson ..... A47C 20/041 5/618
2011/0094032 A1 * 4/2011 Shih ..... A47C 20/041 5/616
2014/0041121 A1 * 2/2014 Shan ..... A47C 21/006 5/618
2014/0053340 A1 * 2/2014 Viberg ..... A47C 20/04 5/657
2014/0123391 A1 * 5/2014 Shan ..... A61G 7/015 5/616
2014/0325759 A1 * 11/2014 Bly ..... A61G 7/015 5/613
2015/0067965 A1 * 3/2015 Xu ..... A61G 7/018 5/616
2015/0107024 A1 * 4/2015 Xu ..... A47C 20/041 5/616
2015/0121623 A1 * 5/2015 Huang ..... A61G 7/018 5/616
2016/0015583 A1 * 1/2016 Dewert ..... A47C 19/12 5/616
2016/0022518 A1 * 1/2016 Shih ..... A61G 7/015 5/616
2017/0071356 A1 * 3/2017 Xu ..... A47C 20/041
2018/0125252 A1 * 5/2018 Chung ..... A47C 20/04
2018/0256423 A1 * 9/2018 Kramer ..... A61G 7/018
2018/0338625 A1 * 11/2018 Nava ..... A47C 19/021
2019/0307621 A1 * 10/2019 Kim ..... A61G 7/005
2020/0029700 A1 * 1/2020 Bratl ..... A47C 20/041
2020/0078238 A1 * 3/2020 Huang ..... A61G 7/012
2020/0214463 A1 * 7/2020 Xie ..... A47C 20/041
2020/0359806 A1 * 11/2020 Wang ..... A47C 21/044
2020/0375368 A1 * 12/2020 Choi ..... A47C 20/04
2020/0397147 A1 * 12/2020 Ren ..... A47C 19/021
2021/0022517 A1 * 1/2021 Bellingroth ..... A47C 19/005
2021/0378411 A1 * 12/2021 Xie ..... A47C 20/041
2022/0095802 A1 * 3/2022 Chen ..... A47C 20/041
2022/0117400 A1 * 4/2022 Zeng ..... A47C 19/12
2022/0248861 A1 * 8/2022 Shan ..... A47C 31/023
2022/0369822 A1 * 11/2022 Ma ..... A47C 19/122

* cited by examiner

FOLDABLE ELECTRIC BED

BACKGROUND OF THE INVENTION

1. Field of the Invention

The present invention relates generally to an electric bed and more particularly, to a foldable electric bed having a slidable function.

2. Description of the Related Art

Conventional electric beds are usually provided with functions of lifting back and legs of the user so as to meet the basic needs of posture adjustment. However, the conventional electric beds may have inconveniences in use. For example, when the electric bed lifts the user's back, the user's shoulder will gradually move away from the head of the bed, resulting in that it is difficult for the user to access items placed on the bedside table or near the head of the bed. If the user wants to easily get the items, the user will need to operate the electric bed to reduce the inclination angle to the user's back. Therefore, the conventional electric bed is inconvenient in use and thus needed to be improved.

Furthermore, because the electric bed needs to adjust the positions and inclined angles of its parts, power mechanisms for driving the parts must be installed in the electric bed. As such, the conventional electric bed is already quite heavy and bulky. If more functions are provided to improve convenience in use, not only more mechanisms will be added, but the overall size and weight will also increase, resulting in higher transportation, storage, and manufacturing costs. As a result, the final market prices of multiple functional electric beds may not be easily accepted by consumers. Therefore, finding a way to balance convenience in use and cost reduction has become an issue to be solved in the industry.

SUMMARY OF THE INVENTION

The present invention has been accomplished in view of the above-noted circumstances. It is an objective of the present invention to provide a foldable electric bed, which will not move the user away from the head of the bed when the user's back is lifted, thereby facilitating the user to take the items around the head of the bed.

It is another objective of the present invention to provide a foldable electric bed, which can be folded to facilitate storage and transportation, thereby reducing cost thereof.

To attain the above objectives, the present invention provides a foldable electric bed comprising a front frame, a rear frame, a first buttock supporting unit, a back supporting unit, a front link, a first actuator, a bottom frame, a second buttock supporting unit, a quick release, a thigh supporting unit, a lower leg supporting unit, a second actuator, and a rear link. The front frame comprises two front guide rails extending in a direction parallel to a front and rear direction. The rear frame comprises two rear guide rails extending in a direction parallel to the front and rear direction, and a front end pivotally connected with the front frame, such that the rear frame is swingable between an extended position and a folded position. The first buttock supporting unit comprises two slide portions slidably disposed with the two front guide rails, respectively. The back supporting unit comprises a rear end pivotally connected with the first buttock supporting unit. The front link has two ends pivotally connected with the front frame and the back supporting unit, respectively.

The first actuator comprises two ends disposed with the first buttock supporting unit and the back supporting unit, respectively. The bottom frame is slidably disposed with the two rear guide rails. The second buttock supporting unit is disposed with the bottom frame and neighbor with the first buttock supporting unit. The quick release is connected with the first and second buttock supporting units. The thigh supporting unit is pivotally connected with a rear end of the second buttock supporting unit. The lower leg supporting unit is pivotally connected with a rear end of the thigh supporting unit. The second actuator comprises two ends disposed with the thigh supporting unit and the bottom frame, respectively. The rear link comprises two ends pivotally connected with the bottom frame and the lower leg supporting unit, respectively. As a result, when the back supporting unit is driven by the first actuator to swing upwardly, the first buttock supporting unit is driven by the back supporting unit to slide forwards along the two front guide rails, and the second buttock supporting unit is driven by the first buttock supporting unit to drive the bottom frame as well as the thigh supporting unit and the lower leg supporting unit to slide forwards along the two rear guide rails.

With the above structural features, when the foldable electric bed lifts the back of a user, the user may not move away from the head of the bed, facilitating the user to take the items near the head of the bed. Further, the foldable electric bed can be conveniently folded to facilitate storage and transportation, and thus reducing the cost thereof.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
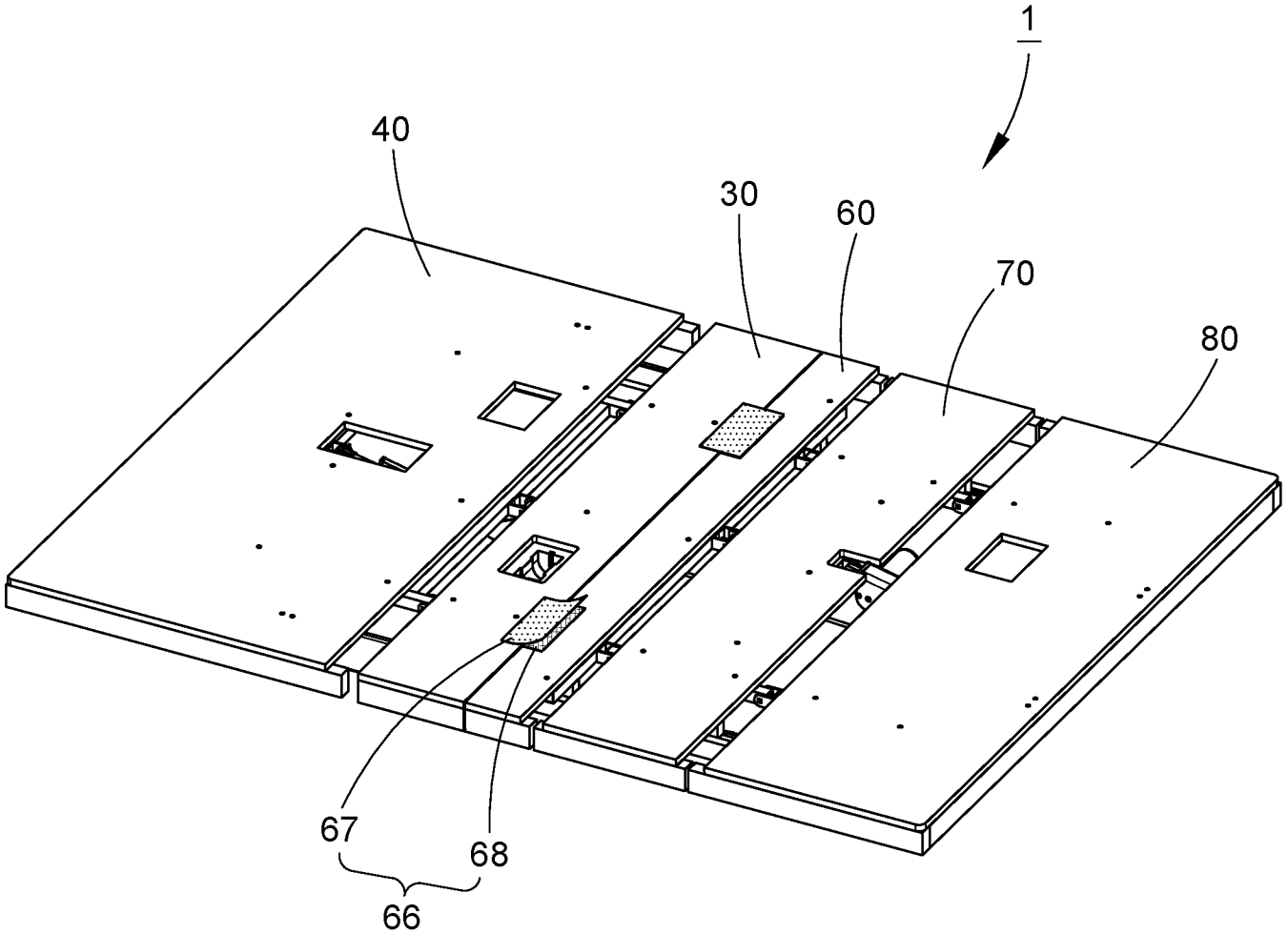
FIG. 1 is a top perspective view of a foldable electric bed according to an embodiment of the present invention in an extended state.
Figure 2:
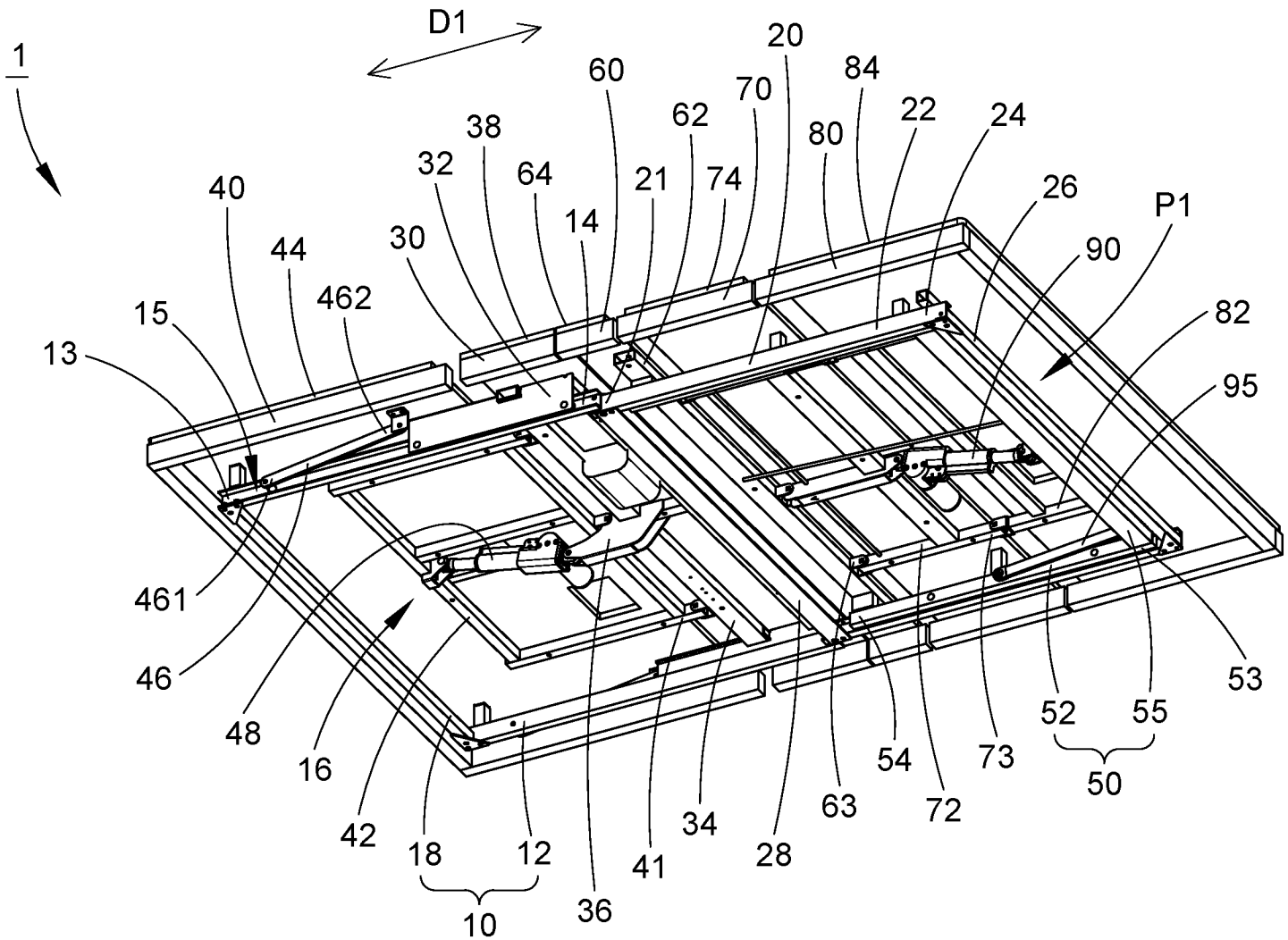
FIG. 2 is a bottom perspective view of the foldable electric bed of the embodiment of the present invention in the extended state.

The structure and technical features of the present invention will be detailedly described hereunder by an embodiment and accompany drawings. As shown in FIGS. 1-2, a foldable electric bed 1 provided in accordance with an embodiment of the present invention comprises a front frame 10, a rear frame 20, a first buttock supporting unit 30, a back supporting unit 40, two front links 46, a first actuator 48, a bottom frame 50, a second buttock supporting unit 60, a quick release 66, a thigh supporting unit 70, a lower leg supporting unit 80, a second actuator 90, and two rear links 95.

Figure 6:
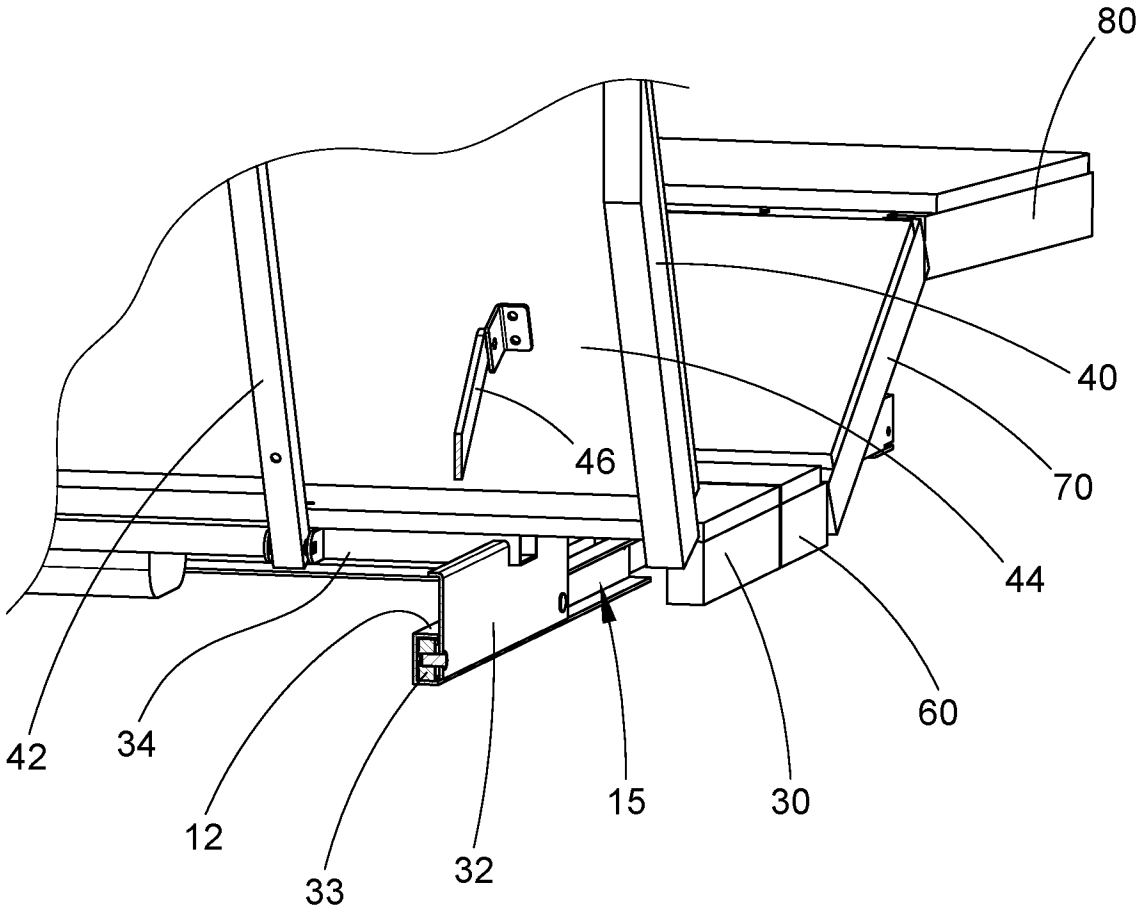
FIG. 6 is a partially cutaway perspective view taken along line 6-6 of FIG. 4.

The front frame 10 includes two front guide rails 12 extending in a direction parallel to a front and rear direction D1, and a front transverse rod 18 having two ends connected with front sections 13 of the two front guide rails 12, respectively. Each of the two front guide rails 12 has a U-shaped cross-section with an opening 15 facing outwardly, as shown in FIG. 6. Further, the aforesaid front and rear direction D1 means the head and tail direction of the foldable electric bed 1, and in the present invention, the front is directed to the direction of the head of the bed and the rear is directed to the direction of the tail of the bed. In another embodiment, the structure of the front frame 10 may be modified as long as it has two parallel front guide rails 12.

Figure 7:
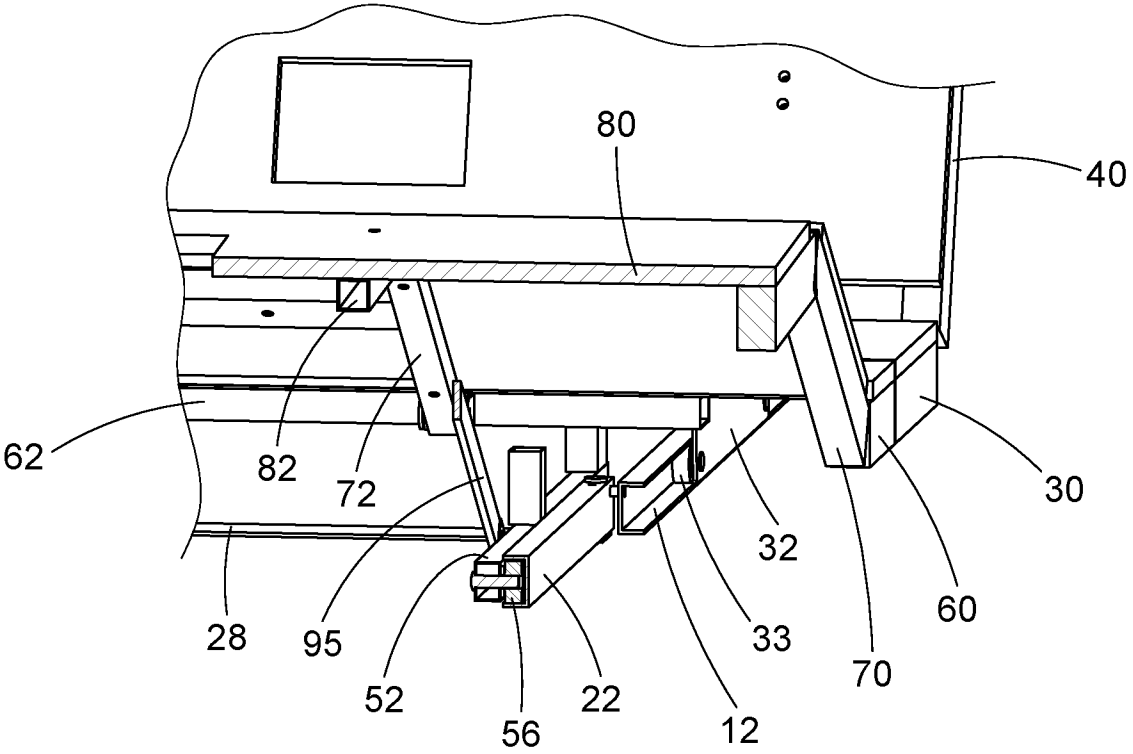
FIG. 7 is a partially cutaway perspective view taken along line 7-7 of FIG. 5.
Figure 8:
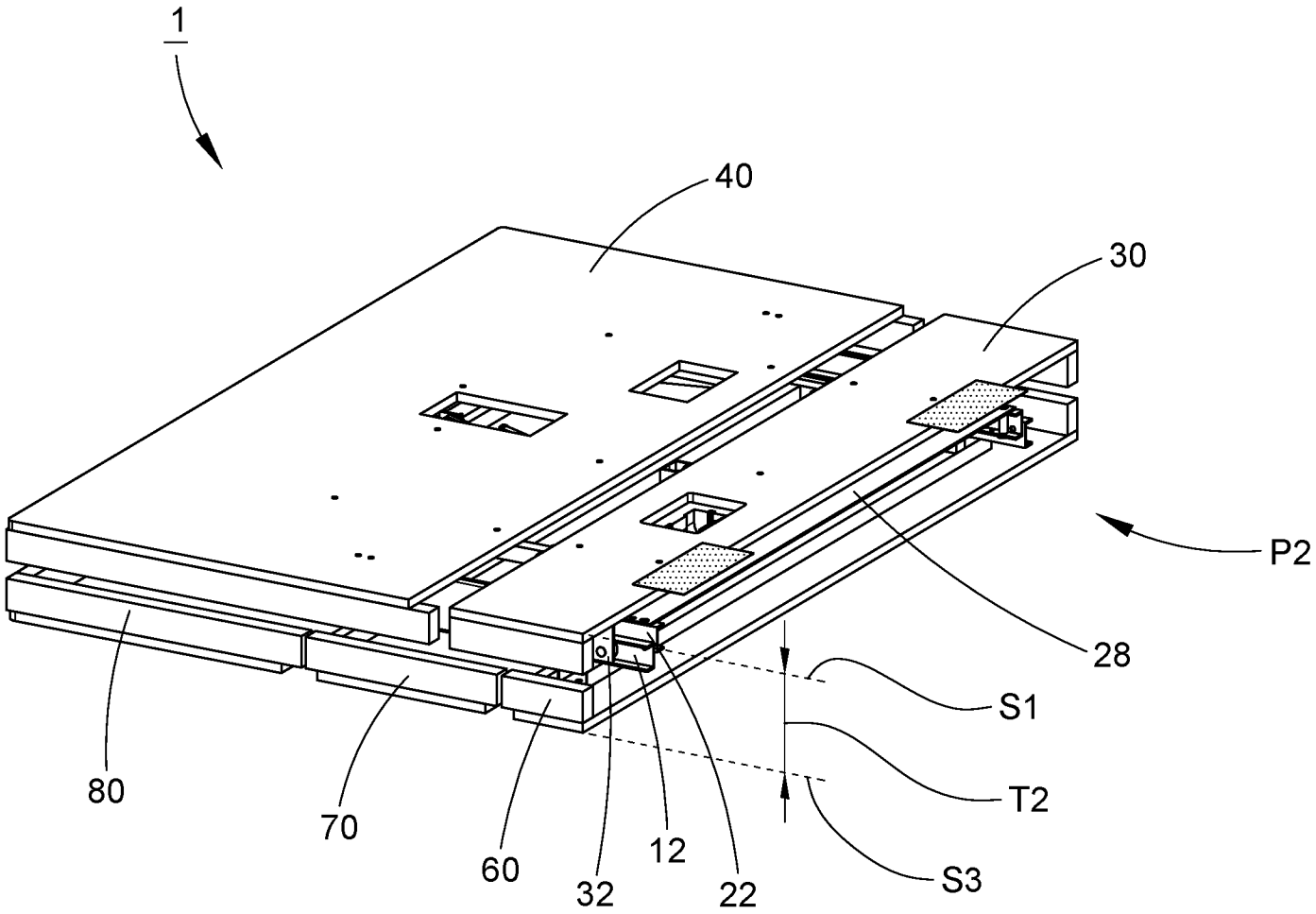
FIG. 8 is a perspective view of the foldable electric bed of the embodiment of the present invention in a folded state.
Figure 9:
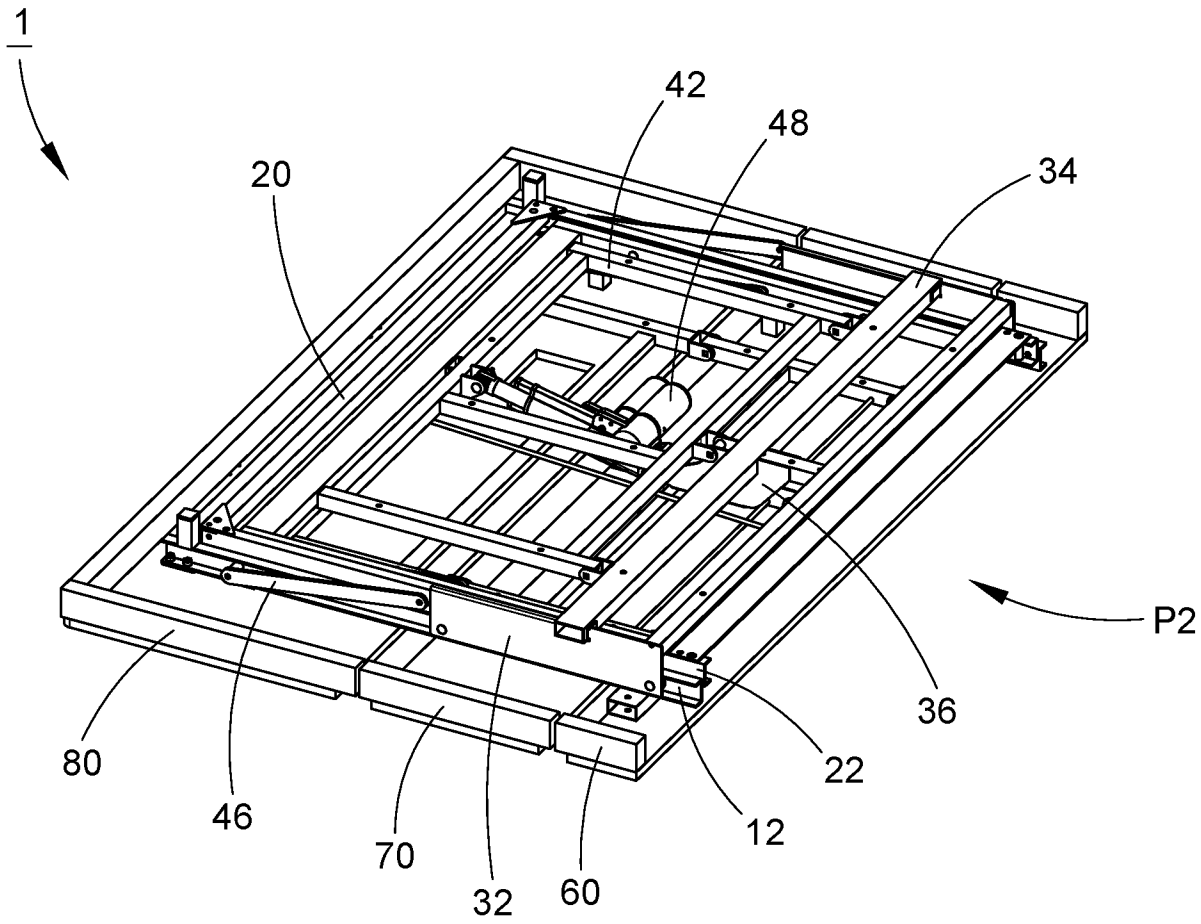
FIG. 9 is a perspective view similar to FIG. 8 but showing that a back supporting plate and a first buttock supporting plate are removed.

The rear frame 20 has a front end 21 pivotally connected with the front frame 10 in such a way that the rear frame 20 is swingable between an extended position P1, as shown in FIGS. 1-5, and a folded position P2, as shown in FIGS. 8-9. The rear frame 20 comprises two rear guide rails 22 extending in a direction parallel to the front and rear direction D1. The two rear guide rails 22 each have a front end pivotally connected with a rear end 14 of one of the two front guide rails 12. The rear frame 20 further comprises a rear transverse rod 26, and a middle transverse rod 28. Each of the two rear guide rails 22 has a rear section 24, and the rear transverse rod 26 has two ends connected with the rear sections 24 of the two rear guide rails 22, respectively. The middle transverse rod 28 has two ends connected with the front ends of the two rear guide rails 22. Each of the two rear guide rails 22 has a U-shaped cross-section with an opening 23 facing inwardly, as shown in FIG. 7. Specifically, the front ends of the two rear guide rails 22 are equivalent as the front end 21 of the rear frame 20. When the rear frame 20 stays at the extended position P1, the foldable electric bed 1 is in a fully extending state as shown in FIGS. 1-5. While the rear frame 20 stays at the folded position P2, the rear frame 20 is located in an inside 16 of the front frame 10, as shown in FIG. 9. The so-called inside 16 of the front frame 10 means the space surrounded by the two front guide rails 12 and the front transverse rod 18. At this state, the foldable electric bed 1 is arranged in a folded state, as shown in FIGS. 8 and 9. In another embodiment, the structure of the rear frame 20 may be modified.

As shown in FIGS. 1-5, the first buttock supporting unit 30 comprises two slide portions 32 slidably disposed with the two front guide rails 12 respectively, a transverse connection portion 34 having two ends connected with the two slide portions 32, a downwardly extending portion 36 extending downwardly from a middle section of the transverse connection portion 34, and a first buttock supporting plate 38 disposed on the transverse connection portion 34 to support the user's buttocks or a mattress. The two slide portions 32 are installed with a plurality of rollers 33 rotatably engaged with the two front guide rails 12 respectively, as shown in FIG. 6, such that the first buttock supporting unit 30 may slide back and forth along the two front guide rails 12. In another embodiment, the rollers 33 may be omitted or replaced by other elements made of engineering plastic as long as the two slide portions 32 may slidably move relative to the two front guide rails 12. Further, the first buttock supporting plate 38 may be omitted. In this way, the transverse connection portion 34 may provide the support function, and the structure of the transverse connection portion 34 is not limited to the one disclosed in this embodiment.

The back supporting unit 40 has a rear end 41 pivotally connected with the first buttock supporting unit 30. The back supporting unit 40 includes a back supporting rack 42 having a rear end pivotally connected with the first buttock supporting unit 30, and a back supporting plate 44 disposed on the back supporting rack 42 for supporting the user's back or the mattress. The rear end of the back supporting rack 42 serves as the rear end 41 of the back supporting unit 40. In another embodiment, the back supporting plate 44 may be omitted, and thus the back supporting rack 42 may provide the support function. Further, the structure of the back supporting rack 42 is not limited to the one disclosed in this embodiment. For example, the back supporting rack 42 may be a net rack.

Each of the front links 46 has two ends pivotally connected with the front frame 10 and the back supporting unit 40, respectively. Specifically, each front link 46 has a front end 461 pivotally connected with one of the two front guide rails 12 of the front frame 10, and a rear end 462 pivotally connected with back supporting plate 44 of the back supporting unit 40. In another embodiment, only one of the two front links 46 is used is sufficient. Furthermore, the front end 461 of the front link 46 may be pivotally connected with another part, such as the front transverse rod 18, of the front frame 10, and the rear end 462 of the front link 46 may be pivotally connected with another part, such as the back supporting rack 42, of the back supporting unit 40.

Figure 3:
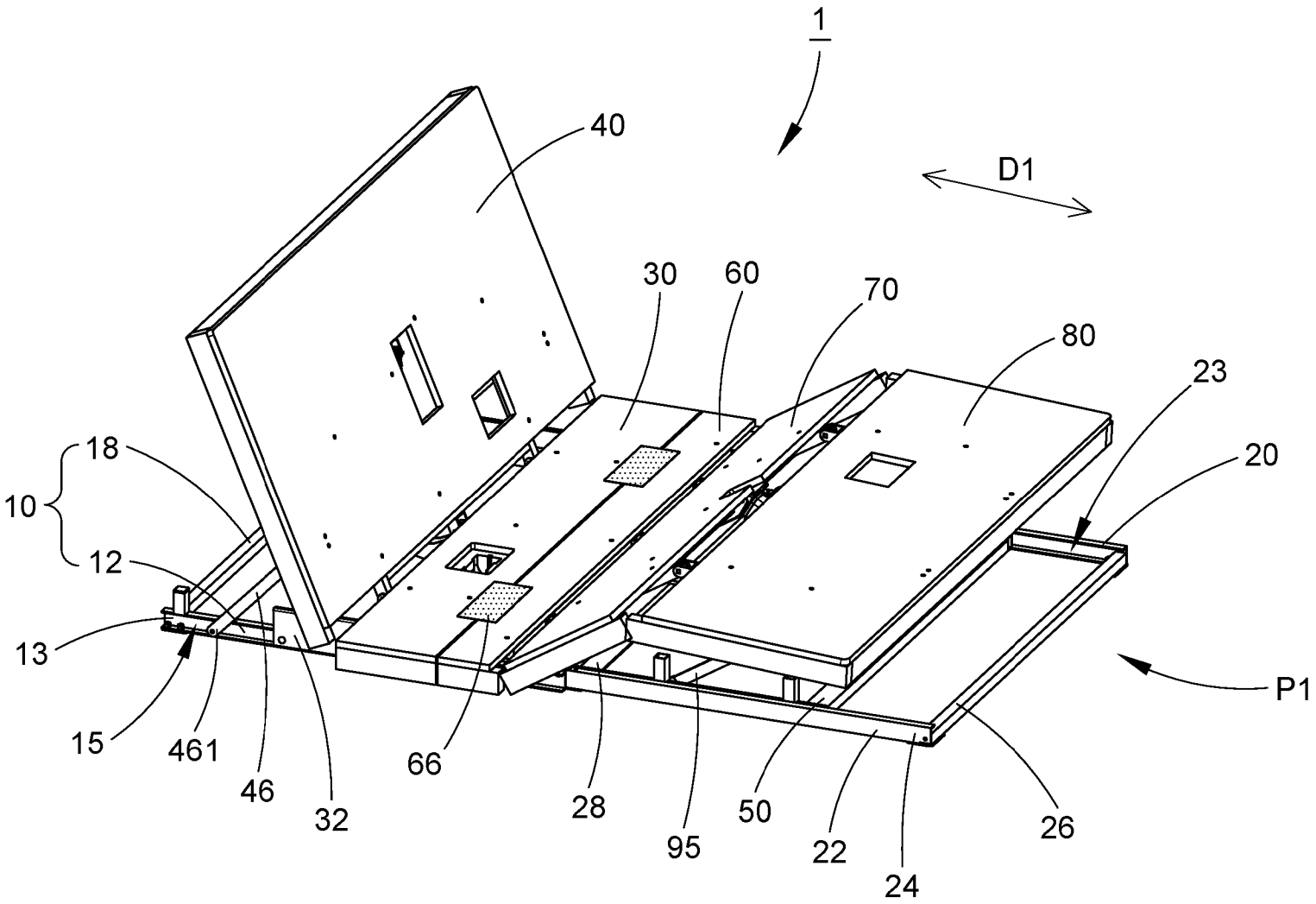
FIG. 3 is a top perspective view of the foldable electric bed of the embodiment of the present invention in a state of use.
Figure 4:
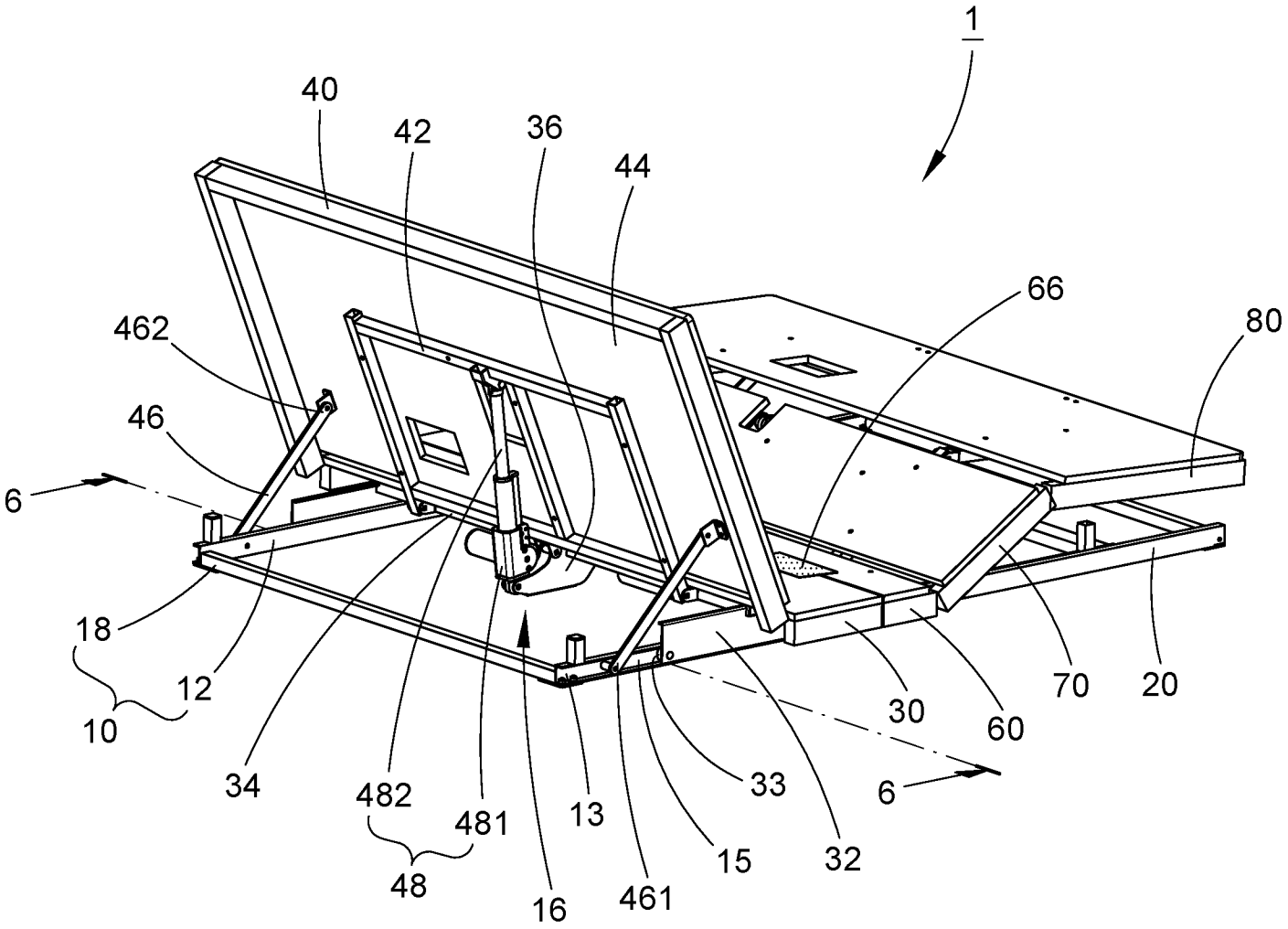
FIG. 4 is another top perspective view of the foldable electric bed of the embodiment of the present invention in the state of use.
Figure 5:
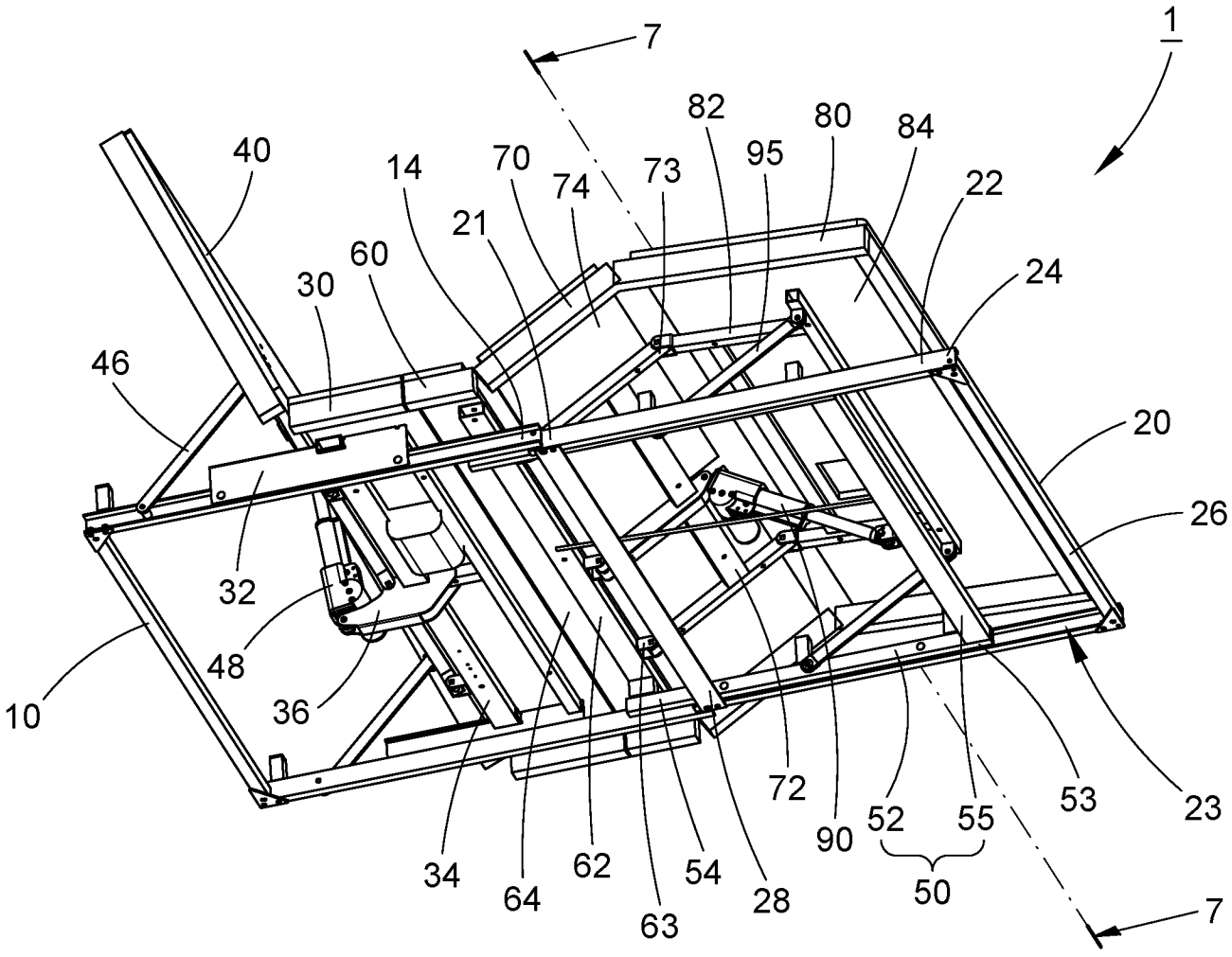
FIG. 5 is a bottom perspective view of the foldable electric bed of the embodiment of the present invention in the state of use.

The first actuator 48 has two ends disposed with the first buttock supporting unit 30 and the back supporting unit 40, respectively. Specifically, the first actuator 48 is an electric linear actuator comprising a motor 481 and a telescope rod 482. However, the first actuator 48 may be a hydraulic cylinder or a pneumatic cylinder. The motor 481 is pivotally connected with the downwardly extending portion 36 of the first buttock supporting unit 30, and the telescope rod 482 is pivotally connected with the back supporting rack 42. As a result, when the telescope rod 482 extends to lengthen the first actuator 48, the back supporting unit 40 is driven by the actuator 48 to swing upwardly, and in the meantime by means of the two front links 46, the first buttock supporting unit 30 as well as the back supporting unit 40 will slide forwards, i.e., move toward the head of the bed, as shown in FIGS. 3-5. On the other hand, when the telescope rod 482 retracts to shorten the first actuator 48, the back supporting unit 40 is driven to swing downwardly, such that the back supporting unit 40 and the first buttock supporting unit 30 slide backwards, i.e., move toward the tail of the bed. The purpose that the motor 481 is disposed with the downwardly extending portion 36 is to increase the arm of force of swinging the back supporting unit 40. In another embodiment, the positions of the motor 481 and telescope rod 482 may be exchanged one from the other, and the first actuator 48 may be installed with another part of the first buttock supporting unit 30 and another part of the back supporting unit 40.

The bottom frame 50 is slidably disposed with the two rear guide rails 22 and located between the two rear guide rails 22. The bottom frame 50 comprises two longitudinal rods 52, a branch rod 55 having two ends connected with the rear sections 53 of the two longitudinal rods 52, and a plurality of rollers 56 mounted at the outer lateral sides of the two longitudinal rods 52 and rotatably engaged with the two rear guide rails 22, as shown in FIG. 7, such that the bottom frame 50 may slide back and forth along the two rear guide rails 22. In another embodiment, the rollers 56 may be omitted or replaced by other elements made of engineering plastic as long as the bottom frame 50 may slidably move relative to the two rear guide rails 22.

The second buttock supporting unit 60 is disposed with front sections 54 of the two longitudinal rods 52 of the bottom frame 50 and neighbor with the first buttock supporting unit 30. The second buttock supporting unit 60 includes a buttock supporting rack 62 fixedly connected with the two longitudinal rods 52, and a second buttock supporting plate 64 disposed on the buttock supporting rack 62 for supporting the user's buttocks or the mattress. In another embodiment, the buttock supporting rack 62 may be omitted, and thus the second buttock supporting plate 64 may be mounted on the bottom frame 50 directly. Alternately, the second buttock supporting plate 64 may be omitted, and thus the buttock supporting rack 62 may provide the support function.

The quick release 66 is connected with the first buttock supporting unit 30 and the second buttock supporting unit 60. Specifically, the quick release 66 comprises a first loop-and-hook fastener 67 disposed with the top surface of the first buttock supporting plate 38 of the first buttock supporting unit 30, and a second loop-and-hook fastener 68 disposed with the top surface of the second buttock supporting plate 64 of the second buttock supporting unit 60 and detachably engaged with the first loop-and-hook fastener 67. The first and second loop-and-hook fasteners 67 and 68 are male and female fasteners of Velcro. With the quick release 66, the second buttock supporting unit 60 may move along with the first buttock supporting unit 30, and the first and second loop-and-hook fasteners 67 and 68 can be easily disengaged from each other, such that the second buttock supporting unit 60 may no longer move along with the first buttock supporting unit 30, facilitating transformation of the electric bed 1 from the extended state, as shown in FIGS. 1-5, to the folded state, as shown in FIGS. 8-9. In another embodiment, the quick release 66 may be a combination of pin and pin hole or other fastening structure, and the quick release 66 may be mounted to any parts of the first and second buttock supporting units 30 and 60 as long as the quick release 66 can quickly connect and disconnect the first and second buttock supporting units 30 and 60 with respect to each other.

The thigh supporting unit 70 is pivotally connected with a rear end 63 of the second buttock supporting unit 60, i.e., the rear end of the buttock supporting rack 62. The thigh supporting unit 70 includes a thigh supporting rack 72 pivotally connected with the buttock supporting rack 62, and a thigh supporting plate 74 mounted on the thigh supporting rack 72 for supporting the user's thighs or the mattress. When the thigh supporting unit 70 stays at a flat posture, the thigh supporting plate 74 is supported by the longitudinal rods 52 of the bottom frame 50. In another embodiment, the thigh supporting plate 74 may be omitted, such that the thigh supporting rack 72 provides the support function.

The lower leg supporting unit 80 is pivotally connected with a rear end 73 of the thigh supporting unit 70, i.e., the rear end of the thigh supporting rack 72. The lower leg supporting unit 80 includes a lower leg supporting rack 82 pivotally connected with the thigh supporting rack 72, and a lower leg supporting plate 84 mounted on the lower leg supporting rack 82 for supporting the user's lower legs or the mattress. When the lower leg supporting unit 80 stays at a flat posture, the lower leg supporting plate 84 is supported by the longitudinal rods 52 of the bottom frame 50. In another embodiment, the lower leg supporting plate 84 may be omitted, such that the lower leg supporting rack 82 provides the support function.

The second actuator 90 has front and rear ends disposed with thigh supporting rack 72 of the thigh supporting unit 70 and the branch rod 55 of the bottom frame 50, respectively. The second actuator 90 is similar in structure to the first actuator 48. Each of the rear links 95 has front and rear ends pivotally connected with one of the longitudinal rods 52 of the bottom frame 50 and the lower leg supporting rack 82 of the lower leg supporting unit 80, respectively. As a result, the thigh supporting unit 70 and the lower leg supporting unit 80 can be driven by the second actuator 90 to change their positions. As shown in FIG. 5, when the second actuator 90 is lengthened, the thigh supporting unit 70 is driven to swing upwardly and the lower leg supporting unit 80 is lifted along with the thigh supporting unit 70. On the other hand, when the second actuator 90 is shortened, the thigh supporting unit 70 is driven to swing downwardly, and the lower leg supporting unit 80 is lowered along with the thigh supporting unit 70. In another embodiment, the second actuator 90 may be installed with another part, such as the thigh supporting plate 74, of the thigh supporting unit 70, and can be installed with another part of the bottom frame 50. Furthermore, one of the rear links 95 may be omitted. The front end of the rear link 95 may be pivotally connected with another part of the bottom frame 50, and the rear end of the rear link 95 may be pivotally connected with another part, such as the lower leg supporting plate 84, of the lower leg supporting unit 80.

With the above-disclosed structural features, when the back supporting unit 40 is driven by the first actuator 48 to swing upwardly, the first buttock supporting unit 30 is driven by the back supporting unit 40 to slide forwards. In the meantime, because the second buttock supporting unit 60 is synchronously movable with the first buttock supporting unit 30 due to the quick release 66 therebetween, the bottom frame 50, the thigh supporting unit 70 and the lower leg supporting unit 80 as well as the second buttock supporting unit 60 will be driven by the back supporting unit 40 to slide forwards. As a result, when the foldable electric bed 1 lifts the back of a user, the user may not move away from the head of the bed, facilitating the user to take the items near the head of the bed. Further, the two front guide rails 12 also provide the function of supporting the front frame 10 and strengthening the structural strength of the front frame 10, the structure of the front frame 10 may be made lighter and compact. In other words, the foldable electric bed 1 has multiple advantages.

Hereinafter the detail of the foldable function of the electric bed 1 is given. As shown in FIGS. 8 and 9, when the first and second loop-and-hoop fasteners 67 and 68 of the quick release 66 are disengaged from each other, and then the rear frame 20 is swung relative to the front frame 10 to the folded position P2, the bottom frame 50, the second buttock supporting unit 60, the thigh supporting unit 70 and the lower leg supporting unit 80 will swing along with the rear frame 20, such that the electric bed 1 can be arranged in a folded state, thereby facilitating storage and transportation, and thus reducing the cost thereof.

Figure 10:
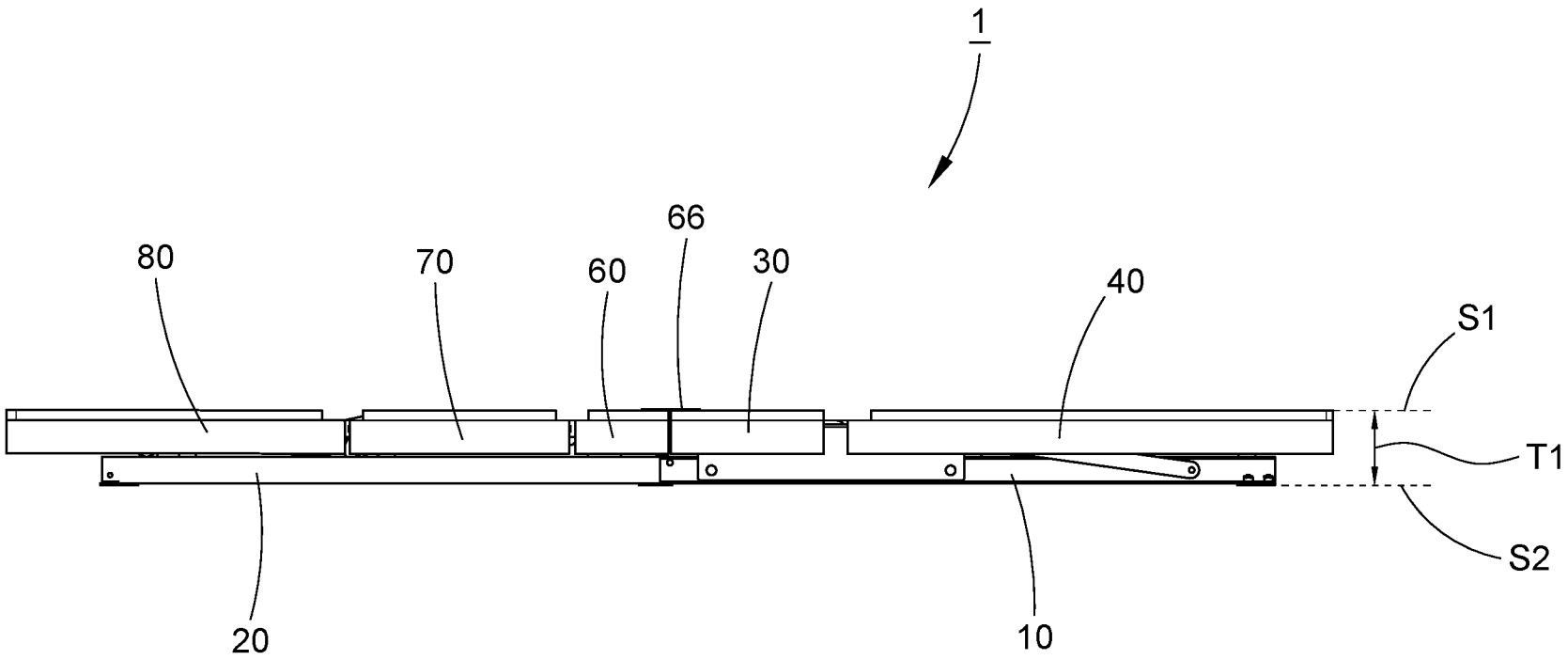
FIG. 10 is a lateral side view of the foldable electric bed of the embodiment of the present invention in an extended state.

Specifically speaking, as shown in FIG. 10, when the rear frame 20 stays at the extended position P1, the foldable electric bed 1 has a first thickness T1. Further, the top sides of the back supporting unit 40, the first buttock supporting unit 30, the second buttock supporting unit 60, the thigh supporting unit 70 and the lower leg supporting unit 80 are flush with each other and located at a first imaginary plane S1, and the bottom sides of the front frame 10 and the rear frame 20 are flush with each other and located at a second imaginary plane S2 parallel to the first imaginary plane S1. The distance between the first and second imaginary planes S1 and S2 is defined as the first thickness T1. As shown in FIG. 8, when the rear frame 20 stays at the folded position P2, the foldable electric bed 1 has a second thickness T2. At this folded state, the top sides of the back supporting unit 40 and the first buttock supporting unit 30 are still located at the first imaginary plane S1, and the top sides of the second buttock supporting unit 60, the thigh supporting unit 70 and the lower leg supporting unit 80 are flush with each other and located at a third imaginary plane S3 parallel to the first imaginary plane S1. The distance between the first and third imaginary planes S1 and S3 is defined as the second thickness T2. Because the front frame 10 and the rear frame 20 are pivotally connected with each other in a way that the rear frame 20 is located in the inside 16 of the front frame 10 when the rear frame 20 stays at the folded position P2, and the installation positions of the components, such as the first and second actuators 48 and 90, are especially arranged, the folded thickness of the electric bed, i.e. the second thickness T2, will be smaller than twice the non-folded thickness of the electric bed, i.e. the first thickness T1. That is, the relationship of the first and second thicknesses T1 and T2 fulfills the inequality T1<T2<2T1. In other words, when the electric bed 1 has been folded, not only the length becomes a half of the original length but the thickness will be less than twice the original thickness. The electric bed 1 of the present invention can be folded in a compact manner with smaller overall volume. For the higher and higher freight and storage costs due to COVID-19 nowadays, the foldable electric bed 1 of the present invention has the advantageous effect of lower cost in transportation and storage.

It is to be further mentioned that when the electric bed 1 stays at the extended state, the bottom sides of all components including the first and second actuators 48 and 90 won't be lower than the second imaginary plane S2 no matter whether the back supporting unit 40 and the thigh supporting unit 70 are lifted. As such, the electric bed 1 can be firmly and stably placed on a general bedstead or the ground or floor by the front and rear frames 10 and 20 when it is in use. Further, the overall thickness of the electric bed 1, i.e., the first thickness T1, is very thin, resulting in that the electric bed 1 will occupy less space in the user's room. This is another advantage of the electric bed 1 of the present invention.

Based on the technical features of the present invention, various modifications to the foldable electric beds 1 may be made. For example, the openings 15 of the front guide rails 12 may face inwardly and the openings 23 of the rear guide rails 22 may face outwardly. Further, the rear frame 20 may be located around an outside of the front frame 10 when the rear frame 20 stays at the folded position. Moreover, the longitudinal rods 52 of the bottom frame 50 may be located outside the two rear guide rails 22, respectively. Such variations are not to be regarded as a departure from the spirit and scope of the invention, and all such modifications as would be obvious to one skilled in the art are intended to be included within the scope of the following claims.

What is claimed is:

1. A foldable electric bed, comprising:

a front frame comprising two front guide rails extending in a direction parallel to a front and rear direction;

a rear frame comprising two rear guide rails extending in a direction parallel to the front and rear direction, the rear frame being pivotally connected with the front frame, such that the rear frame is swingable between an extended position and a folded position;

a first buttock supporting unit comprising two slide portions slidably disposed with the two front guide rails, respectively;

a back supporting unit pivotally connected with the first buttock supporting unit;

a front link pivotally connected with the front frame and the back supporting unit;

a first actuator disposed with the first buttock supporting unit and the back supporting unit;

a bottom frame slidably disposed with the two rear guide rails;

a second buttock supporting unit disposed with the bottom frame and adjacent to the first buttock supporting unit;

a quick release connected with the first and second buttock supporting units;

a thigh supporting unit pivotally connected with the second buttock supporting unit;

a lower leg supporting unit pivotally connected with the thigh supporting unit;

a second actuator disposed with the thigh supporting unit and the bottom frame; and a rear link pivotally connected with the bottom frame and the lower leg supporting unit;

wherein the back supporting unit is drivenable by the first actuator to swing upwardly; the first buttock supporting unit is drivenable by the back supporting unit to slide forwards along the two front guide rails; the second buttock supporting unit is drivenable by the first buttock supporting unit to slide forwards, such that the bottom frame is moved along with the second buttock supporting unit along the two rear guide rails; the thigh supporting unit is drivenable by the second buttock supporting unit to slide forward, such that the lower leg supporting unit is moved along with the thigh supporting unit.

2. The foldable electric bed as claimed in claim 1, wherein when the rear frame stays at the folded position, the rear frame is located in an inside of the front frame.

3. The foldable electric bed as claimed in claim 2, wherein the bottom frame is located between the two rear guide rails.

4. The foldable electric bed as claimed in claim 1, wherein the front frame comprises a front transverse rod, and each of the two front guide rails comprises a front section; the front transverse rod is connected between the front sections of the two front guide rails.

5. The foldable electric bed as claimed in claim 1, wherein the two rear guide rails are pivotally connected with the two front guide rails, respectively.

6. The foldable electric bed as claimed in claim 1, wherein the rear frame comprises a rear transverse rod and a middle transverse rod; each of the two rear guide rails has a front section and a rear section; the rear transverse rod of the rear frame is connected between the rear sections of the two rear guide rails; the middle transverse rod of the rear frame is connected between the front sections of the two rear guide rails.

7. The foldable electric bed as claimed in claim 1, wherein the first buttock supporting unit comprises a transverse connection portion connected with the two slide portions, and a downwardly extending portion, which downwardly extends from the transverse connection portion and is pivotally connected with the first actuator.

8. The foldable electric bed as claimed in claim 1, wherein the two slide portions are installed with a plurality of rollers rotatably engaged with the two front guide rails, respectively.

9. The foldable electric bed as claimed in claim 1, wherein the front link comprises a first front end pivotally connected with the front frame, and a first rear end pivotally connected with the back supporting unit.

10. The foldable electric bed as claimed in claim 1, wherein the back supporting unit comprises a back supporting rack pivotally connected with the first buttock supporting unit and the first actuator.

11. The foldable electric bed as claimed in claim 1, wherein the quick release comprises a first loop-and-hook fastener disposed with the first buttock supporting unit, and a second loop-and-hook fastener disposed with the second buttock supporting unit and detachably engaged with the first loop-and-hook fastener.

12. The foldable electric bed as claimed in claim 1, wherein the second actuator comprises a second front end disposed with the thigh supporting unit, and a second rear end disposed with the bottom frame.

13. The foldable electric bed as claimed in claim 1, wherein the rear link comprises a third front end pivotally connected with the bottom frame, and a third rear end pivotally connected with the lower leg supporting unit.

14. The foldable electric bed as claimed in claim 1, wherein when the rear frame stays at the extended position, the foldable electric bed has a first thickness; when the rear frame stays at the folded position, the foldable electric bed has a second thickness, which is greater than the first thickness and smaller than twice the first thickness.

15. The foldable electric bed as claimed in claim 14, wherein when the rear frame stays at the extended position, top sides of the back supporting unit, the first buttock supporting unit, the second buttock supporting unit, the thigh supporting unit and the lower leg supporting unit are flush with each other and located at a first imaginary plane, and bottom sides of the front frame and the rear frame are flush with each other and located at a second imaginary plane parallel to the first imaginary plane in a way that a distance between the first and second imaginary planes is defined as the first thickness;

wherein when the rear frame stays at the folded position, the top sides of the back supporting unit and the first buttock supporting unit are still located at the first imaginary plane, and the top sides of the second buttock supporting unit, the thigh supporting unit and the lower leg supporting unit are flush with each other and located at a third imaginary plane parallel to the first imaginary plane in a way that a distance between the first and third imaginary planes is defined as the second thickness.

16. The foldable electric bed as claimed in claim 1, wherein the bottom frame is installed with a plurality of rollers rotatably engaged with the two rear guide rails, respectively.

* * * * *